US011105543B2

(12) United States Patent
Wilkins et al.

(10) Patent No.: US 11,105,543 B2
(45) Date of Patent: Aug. 31, 2021

(54) ICE MACHINE

(71) Applicant: Weller Ice, LLC, Louisville, KY (US)

(72) Inventors: Michael Alexander Wilkins, Corydon, IN (US); Charles Hunter Holwerk, New Albany, IN (US)

(73) Assignee: Weller Ice, LLC, Louisville, KY (US)

( * ) Notice: Subject to any disclaimer, the term of this patent is extended or adjusted under 35 U.S.C. 154(b) by 146 days.

(21) Appl. No.: 16/514,322

(22) Filed: Jul. 17, 2019

(65) Prior Publication Data

US 2020/0025426 A1 Jan. 23, 2020

Related U.S. Application Data

(60) Provisional application No. 62/701,179, filed on Jul. 20, 2018.

(51) Int. Cl.
*F25C 1/04* (2018.01)
*F25B 39/00* (2006.01)
(Continued)

(52) U.S. Cl.
CPC ..... *F25B 39/00* (2013.01); *F25C 1/12* (2013.01); *F25B 39/02* (2013.01); *F25B 2339/0242* (2013.01)

(58) Field of Classification Search
CPC .. F25B 39/00; F25B 39/02; F25B 2339/0242; F25C 1/12; F25C 1/06; F28D 7/16; F28F 9/0229
See application file for complete search history.

(56) References Cited

U.S. PATENT DOCUMENTS 2,949,935 A 8/1960 Edmonds
3,016,067 A 1/1962 Edmonds et al.
(Continued)

FOREIGN PATENT DOCUMENTS

CN 2722140 Y 8/2005
CN 201724490 U 1/2011
(Continued)

OTHER PUBLICATIONS

Vogt P-24A & P-34A Tube-Ice Machine Service Manual.
(Continued)

*Primary Examiner* — Henry T Crenshaw
*Assistant Examiner* — Kamran Tavakoldavani
(74) *Attorney, Agent, or Firm* — Stites & Harbison, PLLC; David W. Nagle, Jr.; James R. Hayne

(57) ABSTRACT

An ice machine includes a plurality of cooling tubes with each cooling tube having an inner tube and an outer tube extending around the inner tube to define an annular cavity between the inner tube and the outer tube. When refrigerant flows through the annular cavity between the inner tube and the outer tube, water in the inner tube freezes. The ice machine may also include a shell defining an internal cavity through which the plurality of cooling tubes extend; a water source operably connected to a water pump to flow water through the inner tube; a refrigerant source operably connected to a refrigerant pump to flow refrigerant through the annular cavity; and a heater operably connected to the internal cavity of the shell to flow a heated fluid through the internal cavity and across the plurality of cooling tubes.

18 Claims, 8 Drawing Sheets

(51) Int. Cl.
*F25C 1/12* (2006.01)
*F25B 39/02* (2006.01)

(56) References Cited

U.S. PATENT DOCUMENTS

| | | | | | |
|---|---|---|---|---|---|
| 5,054,547 | A | | 10/1991 | Shipley | |
| 5,435,155 | A | * | 7/1995 | Paradis | F25C 3/04 62/515 |
| 5,536,411 | A | * | 7/1996 | Blades | E01H 4/023 210/638 |
| 5,953,924 | A | * | 9/1999 | Li | F28F 13/125 62/71 |
| 2005/0006056 | A1 | * | 1/2005 | Angel | F28F 9/013 165/81 |
| 2019/0154343 | A1 | * | 5/2019 | Mccormack | C10G 5/06 |

FOREIGN PATENT DOCUMENTS

| | | | | | |
|---|---|---|---|---|---|
| JP | 09-303830 | A | | 11/1997 | |
| KR | 10-0631794 | B1 | | 10/2006 | |
| WO | 95-00808 | A1 | | 1/1995 | |
| WO | WO-9500808 | A1 | * | 1/1995 | B01D 1/222 |

OTHER PUBLICATIONS

Vogt P-24AL & P-34AL Tube-Ice Machine Service Manual.
Korean Intellectual Property Office, International Search Report and Written Opinion issued in corresponding Application No. PCT/US2019/042189, dated Nov. 11, 2019.

* cited by examiner

ICE MACHINE

CROSS-REFERENCE TO RELATED APPLICATIONS

The present application claims priority to U.S. Patent Application Ser. No. 62/701,179 filed on Jul. 20, 2018, the entire disclosure of which is incorporated herein by reference.

BACKGROUND OF THE INVENTION

In ice machine and other forms of heat exchangers, both domestic and international markets are trending towards the use of environmentally friendly refrigerants of two varieties: low global warming potential (GWP) synthetic refrigerants, generically called hydrofluoroolefins (HFOs), and natural refrigerants, chiefly ammonia (R717) and carbon dioxide (R744).

In its earliest days, R717 and R744 were used almost exclusively throughout the ice machine industry. Fear caused by accidents involving these refrigerants lead to the creation of synthetic "non-hazardous" refrigerants like R12 to replace R717 and R744. The next few decades would bring two major phase-out programs after learning of the environmental impact of these substances. A third major phase-out is in progress with the reduction in use of R404A and other HFCs worldwide. Adoption of HFOs have started in Europe, with the rest of the world expected to follow.

R717 has continued to thrive for industrial applications where its efficiency and cost per pound are incomparable; however, new rules from governing agencies around the world have stymied it in urban areas and dramatically increased operational costs where its use is permitted. End users most affected by the latter are those with total charge volumes in excess of 500 lbs. This has been the leading reason for end users to pursue low-charge R717 systems or R717/R744 cascade systems. To qualify as low-charge, it would become necessary for presently available ice machines to see a charge reduction of approximately 82% to 99% while maintaining current capacity. While this may be possible in air cooling applications, the necessarily isothermal evaporator of an ice machine limits the power (or ton of refrigeration) per pound of R717 with the need to run with little to no superheat. To meet the need of a system designed for R744, the working pressure of the evaporator would need to be approximately 800 psi. Both of these needs present a significant challenge for existing designs.

Ice machines which produce tubular ice, such as Tube-Ice® machines, are best known for their longevity, but also for their need for large volumes of refrigerant for operation. (Tube-Ice® is a registered trademark of the applicant, Weller Ice, LLC of Louisville, Ky.) A typical large machine, such as a Vogt® P34AL, requires about 1200 lbs. of R717 just to operate the evaporator; additional refrigerant is required to operate the balance of the system. (Vogt® is also a registered trademark of the applicant, Weller Ice, LLC of Louisville, Ky.) The evaporator charge alone puts the machine installation under the stringent purview of International Institute of Ammonia Refrigeration (IIAR) Standard 2, needing to meet ever more stringent regulations to be installed and operated. A common sight in the industry is to see Tube-Ice® machines or similar machines installed in central ammonia plants having a total charge volume of more than 10,000 lbs. of R717. These locations are subjected to the enforcement of the Environmental Protection Agency (EPA), Department of Homeland Security (DHS), and Occupational Safety and Health Administration (OSHA) (not to mention other local or state level regulation). All end users, even those with lower charge volumes, are under increasing pressure from regulatory agencies and from environmental or social groups to decrease the amount of R717 kept on location.

There is a similar but different force at play driving lower charge requirements for ice machines which produce tubular ice and run on synthetic refrigerant. The same size Tube-Ice® machine discussed above designed for synthetic refrigerants like R404A will require nearly 2400 lbs. of refrigerant for the low side to operate. As R404A rises in cost domestically, end users for large machines will have to pay $80,000 to $100,000 to charge their systems. The option of using R404A no longer exists in Europe, where R404A has been banned for new installations since 2015 due to its high GWP rating. The case for R22 remaining in service is quickly becoming economically impossible as its cost exceeds R404A by more than four times, with greater environmental repercussions stemming from its loss if leaks occur. The current pricing of HFO refrigerants in the United States is such that customers are not yet drawn to its use in ice machines which produce tubular ice—an attitude that is expected to change as the cost declines. While HFO refrigerants are more competitive in Europe, their high manufacturing costs will always put large charge HFO systems at a competitive disadvantage.

Other styles of ice machines have lower charge volumes due to the nature of their evaporator design. However, their design also often makes them economically difficult to meet new R717 industry regulations introduced in 2015. There is a continued increase in requests for new machines with higher working pressures called for in the internationally adopted IIAR Standard 2.

Regulations and economics limit the desirability of any large refrigerant charge, but ice quality and performance remain primary considerations. Offering both would allow end users to embrace a low-charge option, while they maintain current performance, and change their regulatory status regarding total volume of R717 on site. Operators who could reduce their charge volumes below 500 lbs. would no longer be subject to significant federal and state regulation as a result of the charges.

A review of the existing machine designs for use in the higher pressure working environment required for carbon dioxide (R744) operation yields a product not viable to manufacture. Study suggests that the practical working pressure limitation for a current machine evaporator design is approximately 450 psi to 600 psi depending on machine model. This pressure is not high enough to satisfy requirements for operation with R744, and to pursue limits higher than this presents problems with manufacturability and customer economics.

SUMMARY OF THE INVENTION

The present invention is an ice machine that utilizes a tube-in-a-tube design. That is to say, by placing larger tubes around the existing tubes and bundling a plurality of them together in common tubesheeted headers, a small annular refrigerant pathway is created in the space between the smaller (inner) and larger (outer) tube. Water flows on the inside of the smaller tube to make ice.

In one exemplary embodiment of the present invention, an ice machine includes a vertically oriented shell-and-tube heat exchanger with an exterior shell that defines an internal cavity and a plurality of cooling tubes that extend vertically through the internal cavity of the shell. A double-tubesheet is located at the top of the heat exchanger, and a triple-tubesheet is located at the bottom of the heat exchanger. The cooling tubes extend between and are operably connected to the double-tubesheet and the triple-tubesheet. Each cooling tube includes an inner tube and an outer tube, with the outer tube coaxially extending around the inner tube to define an annular cavity between the outside surface of the inner tube and the inside surface of the outer tube.

The double-tubesheet at the top of the heat exchanger includes an upper tubesheet, a lower tubesheet, and an intermediate band connecting the upper tubesheet and the lower tubesheet, thus collectively defining a cavity of the double-tubesheet. The lower tubesheet defines a plurality of holes, with an upper end of one of the outer tubes mated to the lower tubesheet at each of the holes. The upper tubesheet also defines a plurality of holes, with an upper end of one of the inner tubes mated to the upper tubesheet at each of the holes. Each of the inner tubes therefore extends away from the upper tubesheet and through the cavity of the double-tubesheet before passing through an opening of the lower tubesheet and into the respective outer tube to thereby define the annular cavity between the inner tube and the outer tube. Accordingly, the cavity of the double-tubesheet is in fluid communication with the annular cavity between the inner tube and the outer tube of each of the cooling tubes. Furthermore, the intermediate band of the double-tubesheet includes one or more ports into the cavity to allow refrigerant to flow into/out of the cavity and through the annular cavities defined between the inner tubes and the outer tubes of the cooling tubes.

The triple-tubesheet at the bottom of the heat exchanger includes an upper tubesheet, an upper band, a middle tubesheet, a lower band, and a lower tubesheet. The upper band connects the upper tubesheet and the middle tubesheet, thus collectively defining an upper cavity similar to the cavity defined by the double-tubesheet at the top of the heat exchanger. The lower band then connects the middle tubesheet and the lower tubesheet, thus collectively defining a lower cavity, as further discussed below. The upper tubesheet of the triple-tubesheet defines a plurality of holes, with a lower end of one of the outer tubes mated to the upper tubesheet at each of the holes. The lower tubesheet defines a plurality of openings, with a lower end of one of the inner tubes mated to the lower tubesheet at each of the holes. The middle tubesheet defines a plurality of holes, with the exterior of one of the inner tubes mated to the middle tubesheet at each of the holes, thus allowing the inner tubes to pass through the middle tubesheet, while maintaining a seal between the upper cavity and the lower cavity. Each of the inner tubes therefore extends away from the lower tubesheet, through the lower cavity, through an opening in the middle tubesheet, and through the upper cavity before passing through an opening in the upper tubesheet and into the respective outer tube. Accordingly, the upper cavity of the triple-tubesheet is in fluid communication with the annular cavity between the inner tube and the outer tube of each of the cooling tubes. However, the upper cavity is not in direct fluid communication with the lower cavity. The upper band includes one or more ports into the upper cavity to allow refrigerant to flow into/out of the upper cavity and through the annular cavities defined between the inner tubes and the outer tubes of the cooling tubes.

In operation, water pumped from a water source enters at the top of the heat exchanger and is distributed onto the upper tubesheet of the double-tubesheet. The water is then directed downward through the interior of the inner tubes of the cooling tubes before exiting through the bottom of the inner tubes and through the openings in the lower tubesheet of the triple-tubesheet. At the same time, a refrigerant is pumped from a refrigerant source into the upper cavity of the triple-tubesheet at the bottom of the heat exchanger. The refrigerant then flows through the holes in the upper tubesheet and into the annular cavity defined between the inner tubes and the outer tubes of the cooling tubes. Accordingly, in this exemplary implementation, the refrigerant is directed upward through the annular cavity before entering the cavity of the double-tubesheet before exiting the heat exchanger.

As a result of such a construction, heat is transferred from the water to the refrigerant, causing ice to form on the interior surfaces of the inner tubes. After the appropriate amount of ice is produced, an ice removal process is executed.

In one exemplary embodiment, the ice is removed by flowing a warm fluid, such as air or water, between the cooling tubes within the internal cavity of the heat exchanger. In particular, heated fluid is pumped into the internal cavity of the heat exchanger. The fluid then passes through the inner cavity with baffles providing relatively uniform flow across all of the cooling tubes before the fluid exits the internal cavity of the heat exchanger. According to this exemplary embodiment, as the cooling tubes gradually heat up, a thin layer of ice is melted, and the tubes of ice are released from the heat exchanger.

In other embodiments, however, the internal cavity of the heat exchanger is filled with insulating material to avoid excessive environmental heat loads on the smaller heat transfer surfaces. As such, other ice removal processes are also contemplated. For example, in another exemplary embodiment, the ice is removed by displacing the cold refrigerant with a warm refrigerant, for example a warm refrigerant gas, in the annular cavity between the inner tubes and the outer tubes. As the refrigerant is heated, a thin layer of ice is melted, and the tubes of ice are released from the heat exchanger. In some particular embodiments, the warm refrigerant displaces the cold refrigerant to a holding drum, where it is retained temporarily in order to reduce the time required to pull down the temperature for the next ice making cycle.

DETAILED DESCRIPTION OF THE INVENTION

The present invention is an ice machine that utilizes a tube-in-a-tube design. That is to say, by placing larger tubes around the existing tubes and bundling a plurality of them together in common tubesheeted headers, a small annular refrigerant pathway is created in the space between the smaller (inner) and larger (outer) tube. Water flows on the inside of the smaller tube to make ice.

Figure 1:
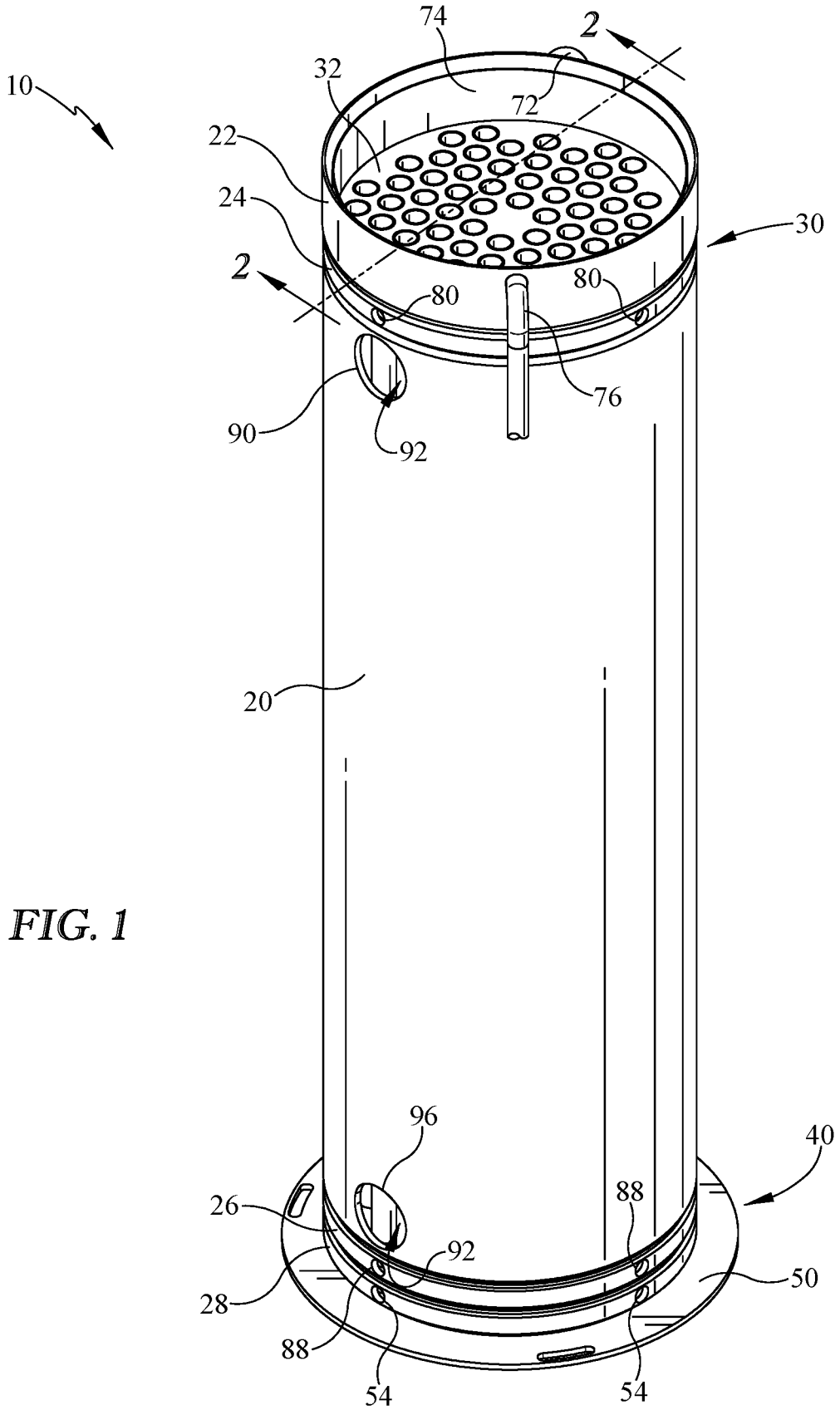
FIG. 1 is a perspective view of an exemplary heat exchanger of an ice machine made in accordance with the present invention.
Figure 2:
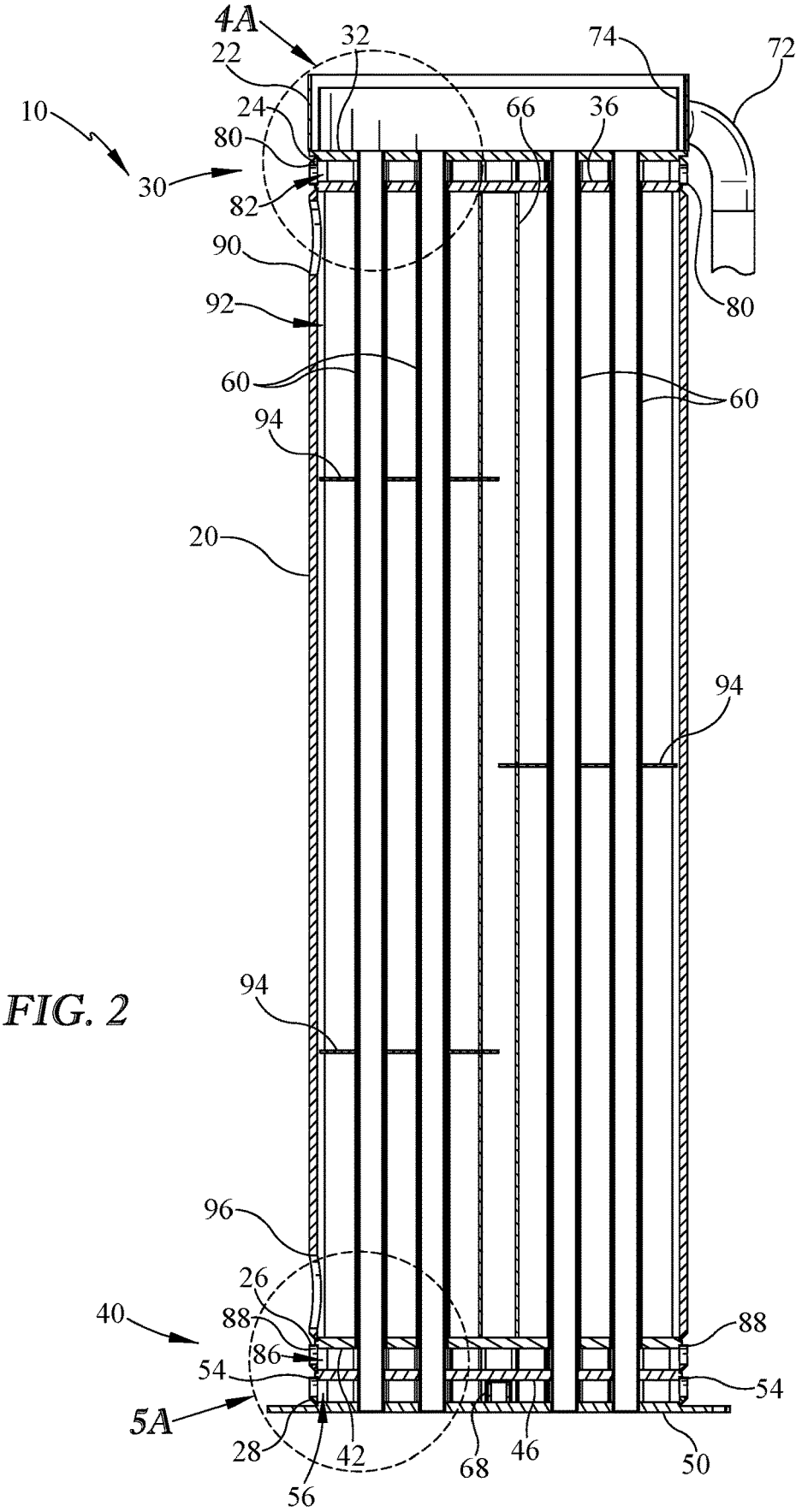
FIG. 2 is a side-sectional view of the exemplary heat exchanger taken along line 2-2 of FIG. 1.
Figure 3:
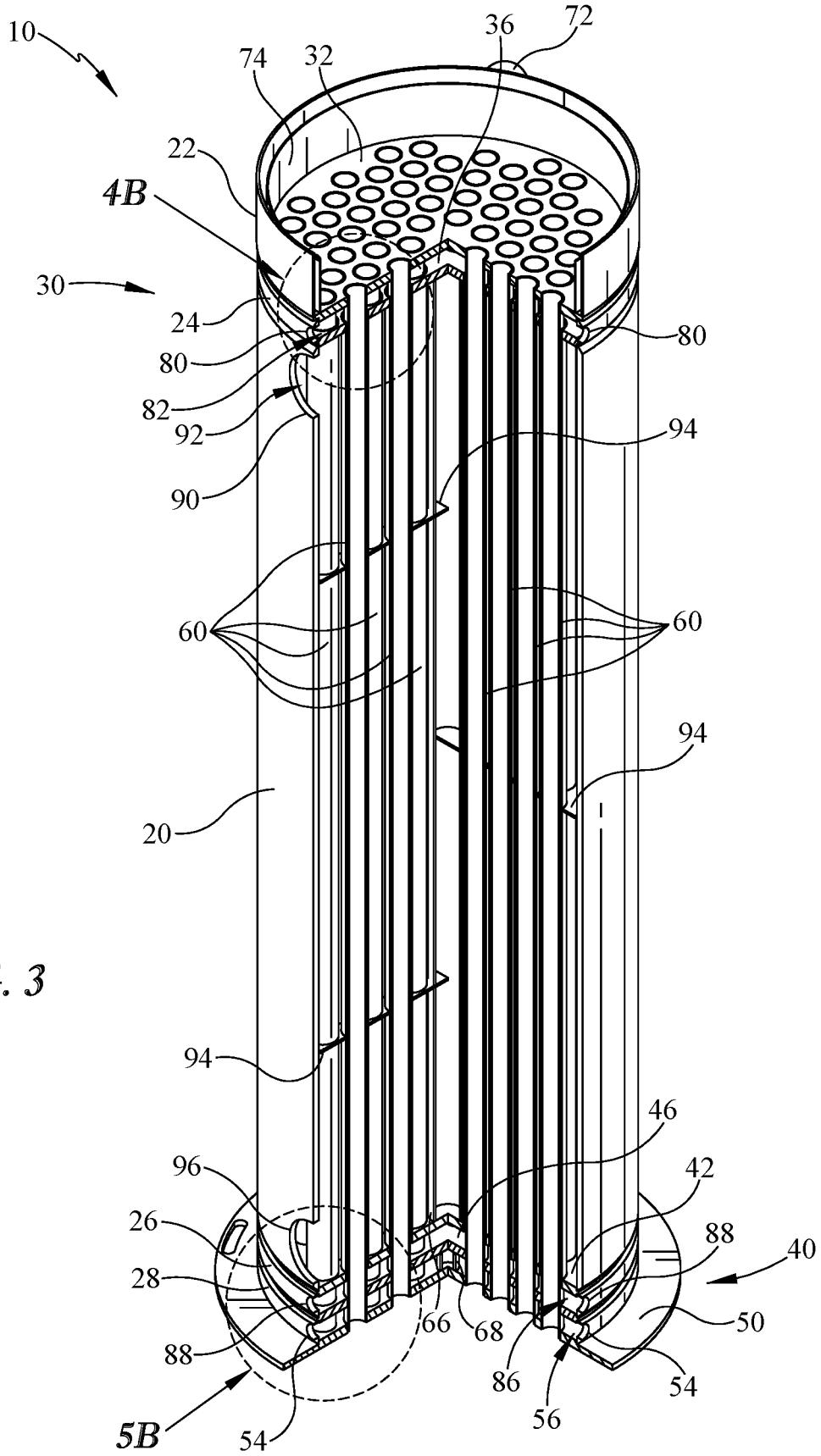
FIG. 3 is a partial cutaway view of the exemplary heat exchanger of FIG. 1.

Referring first to FIGS. 1-3, in one exemplary embodiment of the present invention, an ice machine includes a heat exchanger 10, which, in this case, is a vertically oriented shell-and-tube heat exchanger. As is typical of such shell-and-tube heat exchangers, the heat exchanger 10 includes an exterior shell 20 that defines an internal cavity 92 which houses a plurality of cooling tubes 60 that are spaced apart from each other. That is to say, the plurality of cooling tubes 60 extend vertically through the internal cavity 92 of the shell 20. As further discussed below, a double-tubesheet 30 is located at the top of the heat exchanger 10, and a triple-tubesheet 40 is located at the bottom of the heat exchanger 10. At the upper end of the heat exchanger 10, an outer collar 22 extends around the perimeter of the double-tubesheet 30, and an inner collar 74 extends upward from the double-tubesheet 30 inside of and at a spaced distance from the outer collar 22. The height of the inner collar 74 is slightly less than the height of the outer collar 22, the importance of which is further discussed below. A water feedpipe 72 (perhaps best shown in FIG. 2) and an overflow pipe 76 (shown only in FIG. 1) are connected to the outer collar 22, the use of which is further discussed below.

As shown in FIGS. 2 and 3, each of the cooling tubes 60 extends between and is operably connected to the double-tubesheet 30 and the triple-tubesheet 40. Referring now to FIGS. 4A, 4B, 5A, and 5B, each cooling tube 60 includes an inner tube 62 and an outer tube 64, with the outer tube 64 coaxially extending around the inner tube 62 to define an annular cavity 84 between the outside surface of the inner tube 62 and the inside surface of the outer tube 64. As further discussed below, the double-tubesheet 30 and the triple-tubesheet 40 permit water to flow through each of the inner tubes 62 and refrigerant to flow through the annular cavities 84 between the inner tubes 62 and the outer tubes 64.

Figure 4A:
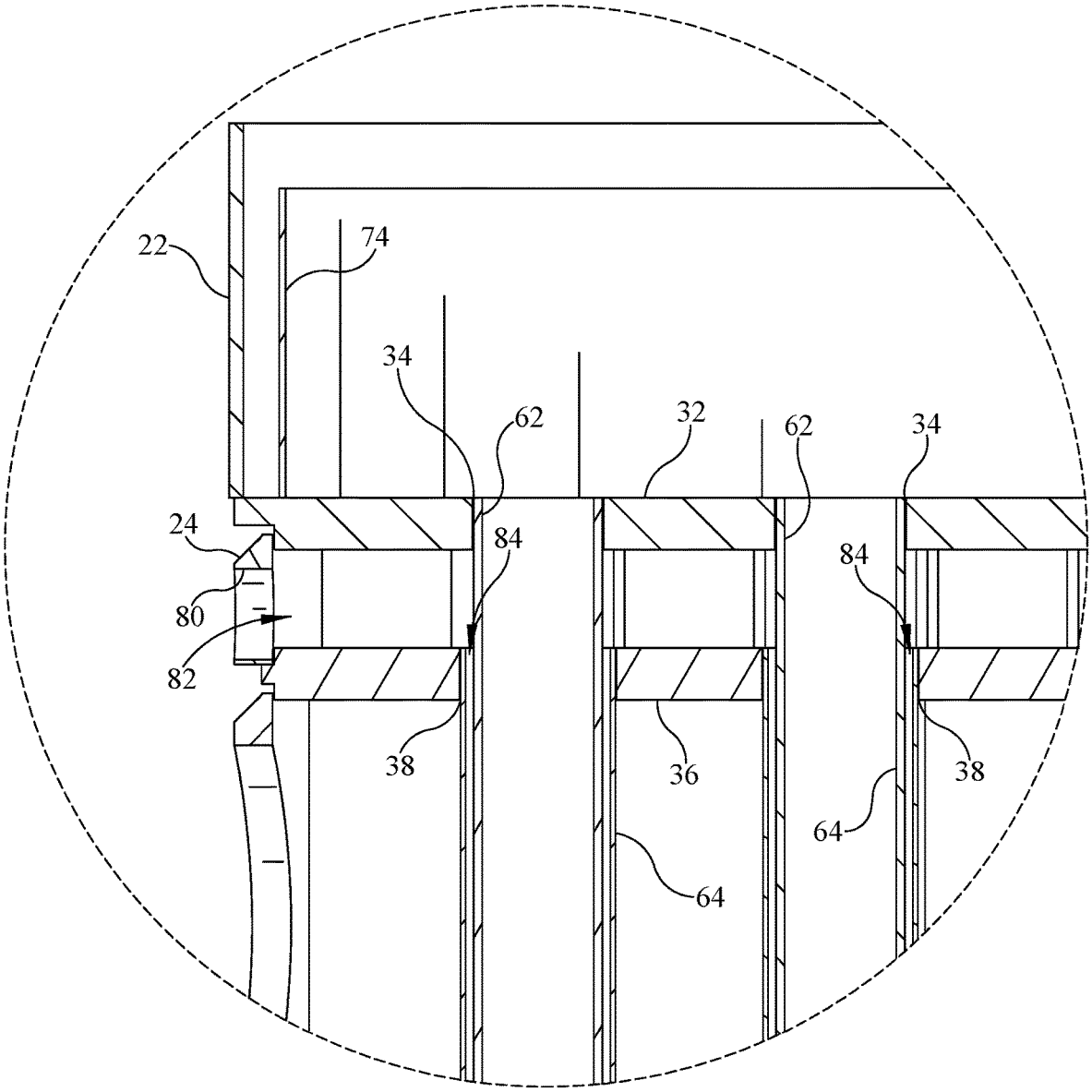
FIG. 4A is an enlarged view of the area 4A of FIG. 2, illustrating details of the double-tubesheet at the top of the exemplary heat exchanger.
Figure 4B:
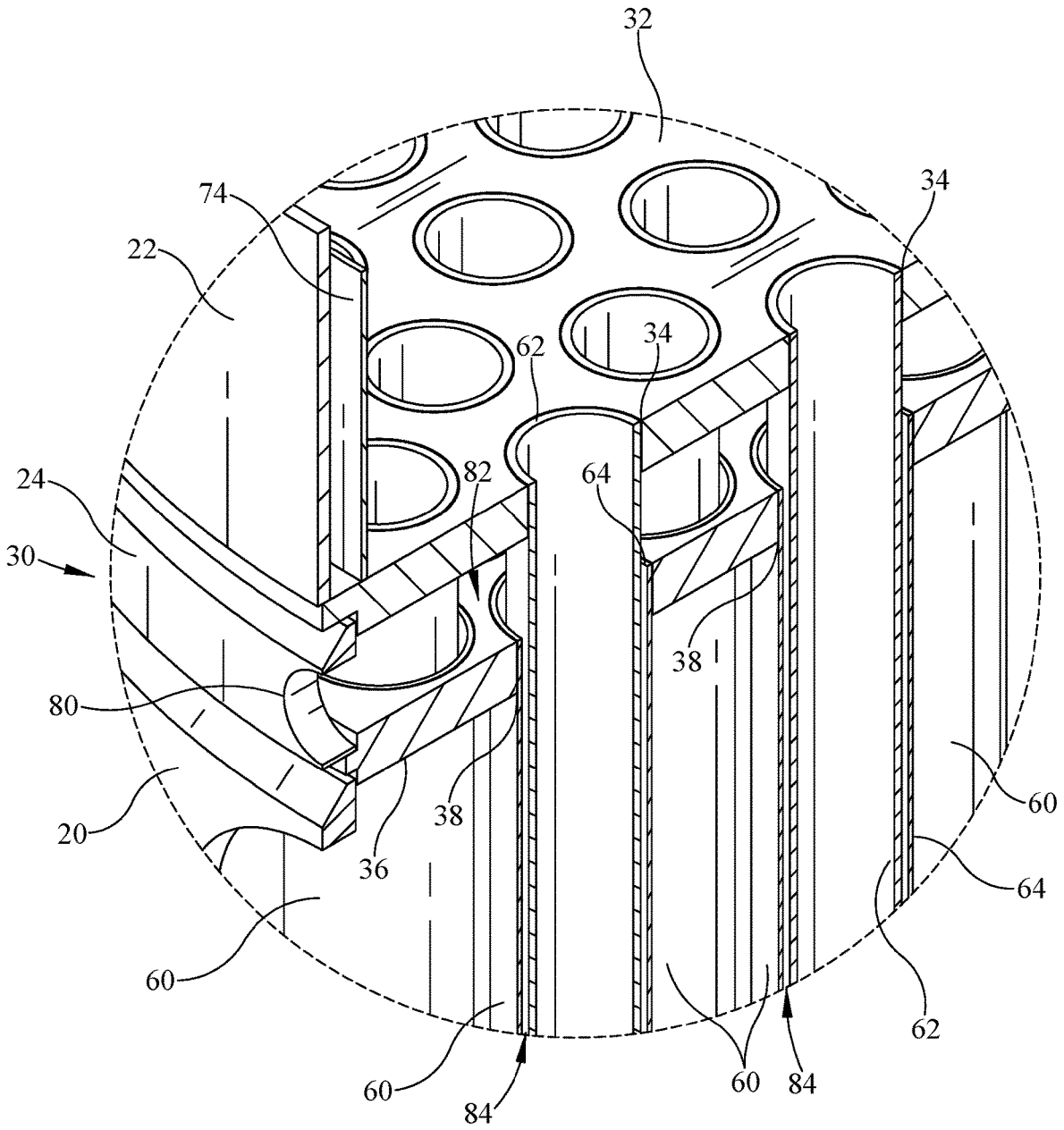
FIG. 4B is an enlarged view of the area 4B of FIG. 3, illustrating details of the double-tubesheet at the top of the exemplary heat exchanger.

As perhaps best shown in FIGS. 4A and 4B, the double-tubesheet 30 at the top of the heat exchanger 10 includes an upper tubesheet 32, a lower tubesheet 36, and an intermediate band 24 connecting the upper tubesheet 32 and the lower tubesheet 36, thus collectively defining a cavity 82 of the double-tubesheet 30.

Referring now still to FIGS. 4A and 4B, the lower tubesheet 36 defines a plurality of holes 38, with an upper end of one of the outer tubes 64 mated to the lower tubesheet 36 at each of the holes 38. The upper tubesheet 32 defines a plurality of holes 34, with an upper end of one of the inner tubes 62 mated to the upper tubesheet 32 at each of the holes 34. Each of the inner tubes 62 therefore extends away from the upper tubesheet 32 and through the cavity 82 of the double-tubesheet 30 before passing through a hole 38 of the lower tubesheet 36 and into the respective outer tube 64 to thereby define the annular cavity 84 between the inner tube 62 and the outer tube 64. Accordingly, the cavity 82 of the double-tubesheet 30 is in fluid communication with the annular cavity 84 between the inner tube 62 and the outer tube 64 of each of the cooling tubes 60. Furthermore, and referring now to FIGS. 1-3, 4A, and 4B, the intermediate band 24 of the double-tubesheet 30 includes one or more ports 80 into the cavity 82. In some embodiments, multiple ports 80 surround the perimeter of the double-tubesheet 30 for optimum refrigerant flow. For example, in one particular embodiment, four ports 80 (only two of which are visible in each of FIGS. 1-3) are equally spaced around the perimeter of the double-tubesheet 30. Although not shown, pipes or tubes are operably connected to the ports 80. In this way, refrigerant can flow into/out of the cavity 82 and through the annular cavities 84 defined between the inner tubes 62 and the outer tubes 64 of the cooling tubes 60, as further discussed below.

Referring now to FIGS. 1-3, 5A, and 5B, the triple-tubesheet 40 at the bottom of the heat exchanger 10 includes an upper tubesheet 42, an upper band 26, a middle tubesheet 46, a lower band 28, and a lower tubesheet 50. The upper band 26 connects the upper tubesheet 42 and the middle tubesheet 46, thus collectively defining an upper cavity 86 similar to the cavity 82 defined by the double-tubesheet 30 at the top of the heat exchanger 10. The lower band 28 likewise connects the middle tubesheet 46 and the lower tubesheet 50, thus collectively defining a lower cavity 56, as further discussed below.

Figure 5A:
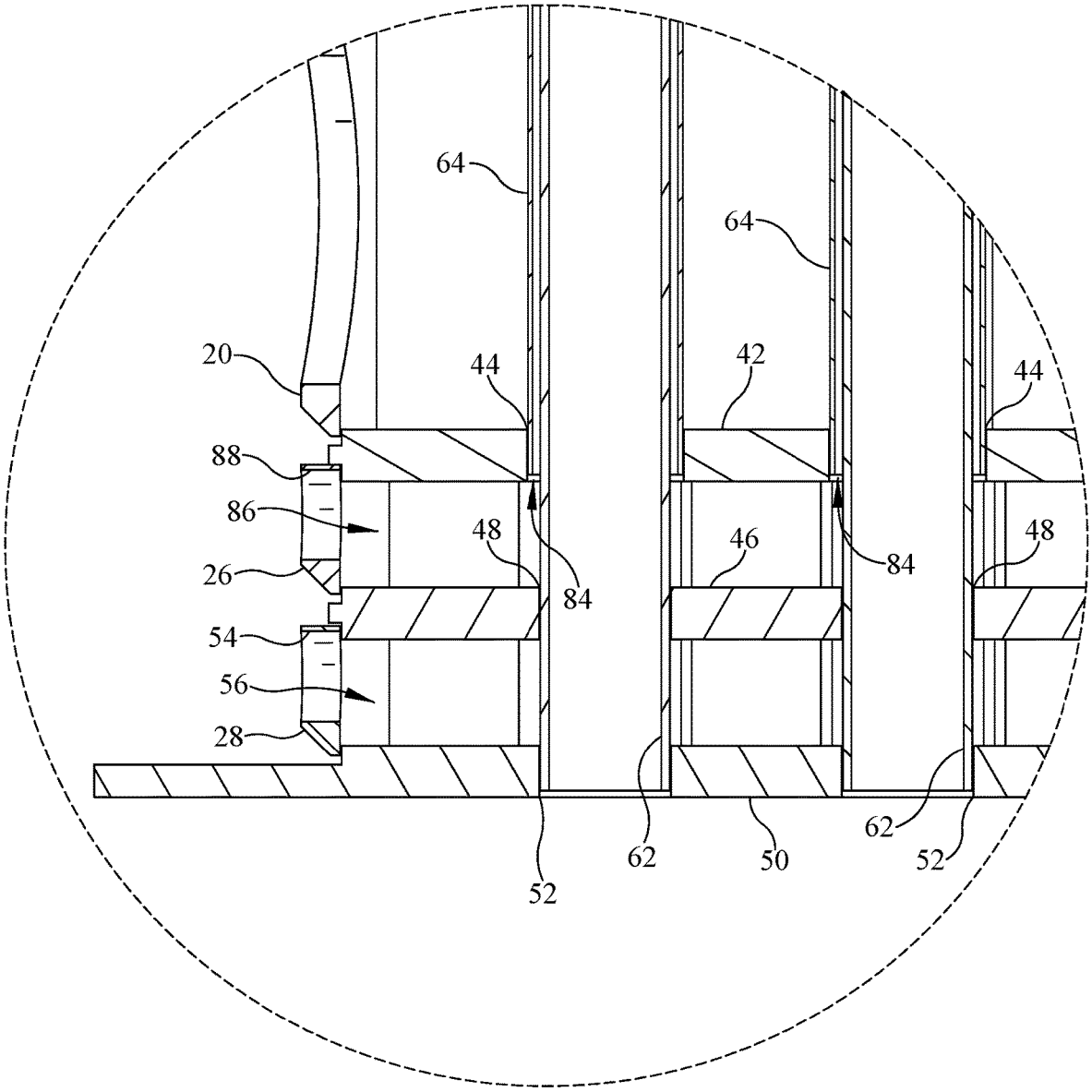
FIG. 5A is an enlarged view of the area 5A of FIG. 2, illustrating details of the triple-tubesheet at the bottom of the exemplary heat exchanger.
Figure 5B:
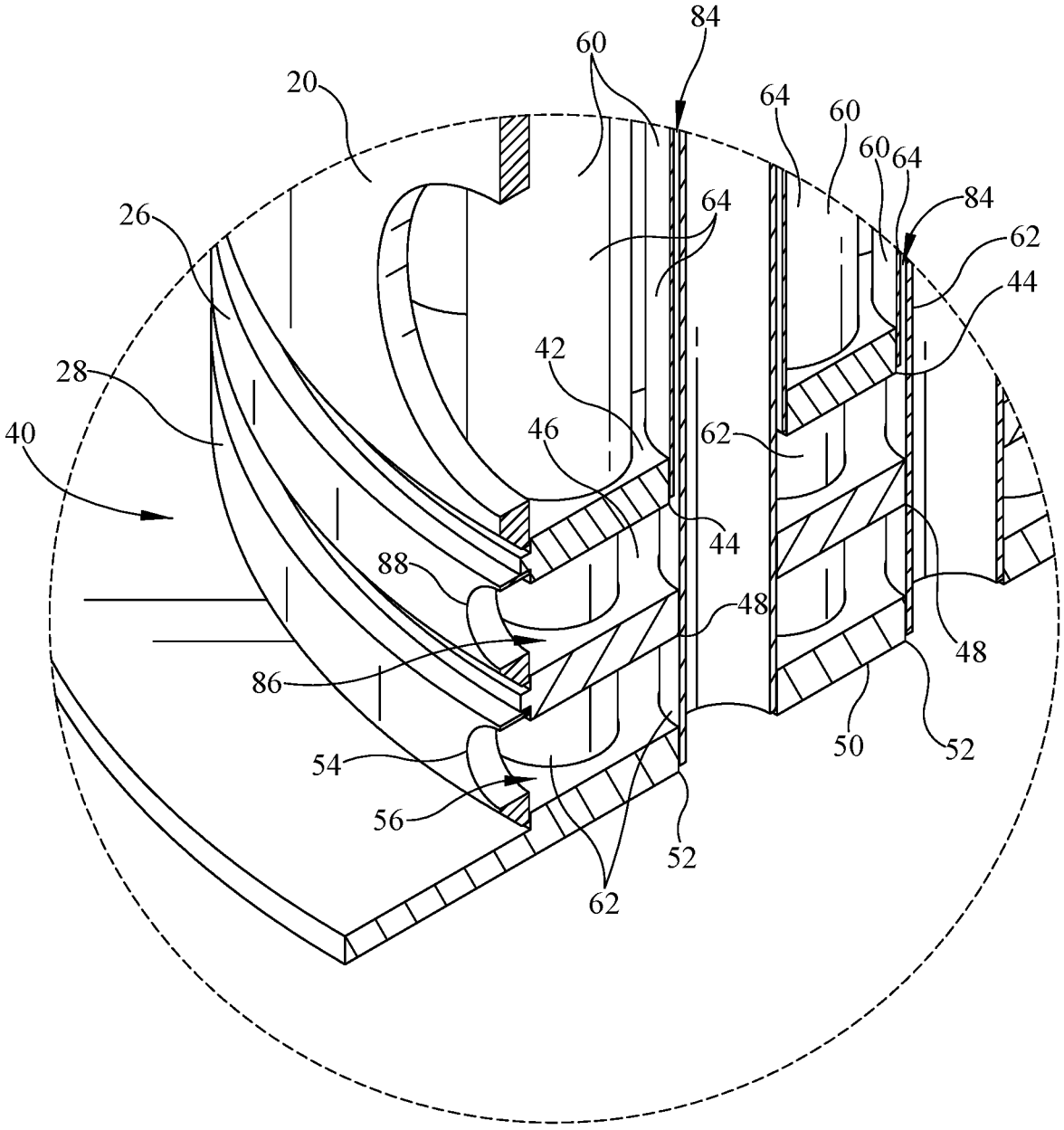
FIG. 5B is an enlarged view of the area 5B of FIG. 3, illustrating details of the triple-tubesheet at the bottom of the exemplary heat exchanger.

Referring now specifically to FIGS. 5A and 5B, the upper tubesheet 42 of the triple-tubesheet 40 defines a plurality of holes 44, with a lower end of one of the outer tubes 64 mated to the upper tubesheet 42 at each of the holes 44. The lower tubesheet 50 defines a plurality of openings 52, with a lower end of one of the inner tubes 62 mated to the lower tubesheet 50 at each of the holes 44. The middle tubesheet 46 defines a plurality of holes 48, with the exterior of one of the inner tubes 62 mated to the middle tubesheet 46 at each of the holes 48, thus allowing the inner tubes 62 to pass through the middle tubesheet 46, while maintaining a seal between the upper cavity 86 and the lower cavity 56. Each of the inner tubes 62 therefore extends away from the lower tubesheet 50, through the lower cavity 56, through an opening 48 in the middle tubesheet 46, and through the upper cavity 86 before passing through an opening 44 in the upper tubesheet 42 and into the respective outer tube 64. Accordingly, the upper cavity 86 of the triple-tubesheet 40 is in fluid communication with the annular cavity 84 between the inner tube 62 and the outer tube 64 of each of the cooling tubes 60. However, the upper cavity 86 is not in direct fluid communication with the lower cavity 56.

Referring again to FIGS. 1-3, 5A, and 5B, and with respect to the upper cavity 86 of the triple-tubesheet 40 in particular, the upper band 26 includes one or more ports 88 into the upper cavity 86. In some embodiments, multiple ports 88 are located around the perimeter of the triple-tubesheet 40, between the upper tubesheet 42 and the middle tubesheet 46. For example, in one particular embodiment, four ports 88 (only two shown in each of FIGS. 1-3) are equally spaced around the perimeter of the triple-tubesheet 40. Although not shown, pipes or tubes are operably connected to the ports 88. In this way, refrigerant can flow into/out of the upper cavity 86 and through the annular cavities 84 defined between the inner tubes 62 and the outer tubes 64 of the cooling tubes 60, as further discussed below.

Referring still to FIGS. 1-3, 5A, and 5B, and with respect to the lower cavity 56 of the triple-tubesheet 40 in particular, the lower band 28 includes one or more ports 54 which act as inlets/outlets for refrigerant into the lower cavity 56, as further discussed below. In some embodiments, multiple ports 54 are located around the perimeter of the triple-tubesheet 40 between the middle tubesheet 46 and the lower tubesheet 50. In some embodiments, multiple ports around the perimeter may be required for optimum subcooling effect, as further discussed below. Although not shown, pipes or tubes are operably connected to the ports 54. In this way, refrigerant can flow into/out of the lower cavity 56. In particular, it is contemplated that pipes connected to some of the ports 54 of the lower cavity 56 are also connected to some of the ports 88 of the upper cavity 86 such that refrigerant can flow between the lower cavity 56 and the upper cavity 86, as further discussed below, Referring once again to FIGS. 1-3, the shell 20 of the heat exchanger 10 defines a port 90 in fluid communication with the top of the internal cavity 92 and a port 96 in fluid communication with the bottom of the internal cavity 92. These ports 90, 96 provide for the flow of fluid into and out of the internal cavity 92 of the heat exchanger 10. Furthermore, baffles 94 (shown in FIGS. 2 and 3) within the internal cavity 92 allow for controlled flow of the fluid through the internal cavity 92 of the heat exchanger 10 around the cooling tubes 60, as further discussed below.

In the exemplary embodiment shown, the outer collar 22, intermediate band 24, shell 20, upper band 26, and lower band 28 are each separate cylindrical members. In other embodiments, one or more of these members are unitarily formed. For example, in one particular embodiment, a single cylindrical member forms each of the outer collar 22, intermediate band 24, shell 20, upper band 26, and lower band 28. In such embodiments, the upper and lower tubesheets 32, 36 of the double-tubesheet 30 and the upper and middle tubesheets 42, 46 of the triple-tubesheet 40 are connected to the interior of the single cylindrical member itself, with the various ports 54, 80, 88, 90, 96 formed through the single cylindrical member to access the respective cavity 56, 82, 86, 92.

Referring now to FIGS. 2 and 3, the exemplary ice machine further includes a support 66 located within the internal cavity 92 of the shell 20 extending between the lower tubesheet 36 of the double-tubesheet 30 at the top of the heat exchanger 10 and upper tubesheet 42 of the triple-tubesheet 40 at the bottom of the heat exchanger 10. Likewise, another support 68 is located within the lower cavity 56 of the triple-tubesheet 40 extending between the middle tubesheet 46 and the lower tubesheet 50. The supports 66, 68 add stiffness to the vessel to handle higher pressure, but no liquid or gas flows through the supports 66, 68.

Figure 6:
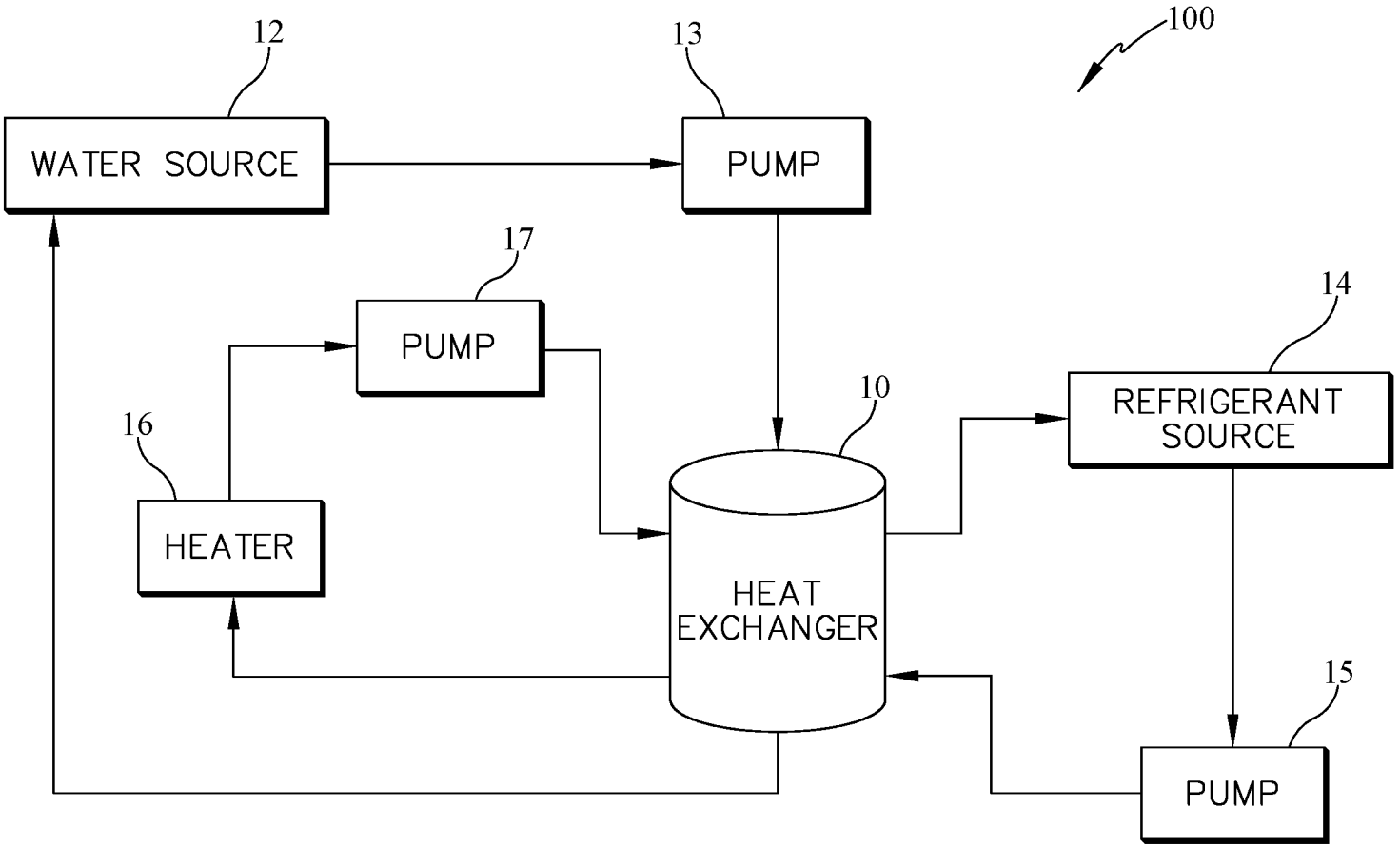
FIG. 6 is a schematic representation of the core components of an exemplary ice machine made in accordance with the present invention.

Referring now to FIG. 6, in addition to the heat exchanger 10, an exemplary ice machine 100 further includes various components to provide for the flow of the fluids through the heat exchanger 10. In particular, a water source 12 and corresponding water pump 13 are included to provide a flow of water through the feedpipe 72 (see FIG. 1) into the top of the heat exchanger 10 with excess water, such as from the overflow pipe 76 (see FIG. 1) or out of the bottom of the heat exchanger 10, returning to the water source 12. Likewise, water which flows through the inner tubes 62 which is not frozen is collected and returned to the water source 12. Furthermore, a refrigerant source 14 and corresponding refrigerant pump 15 are included to provide a flow of refrigerant through the heat exchanger 10. Further still, in this exemplary embodiment, a heater 16 and corresponding pump 17 are included to provide a flow of a heated fluid through the heat exchanger 10. Of course, the particular location and arrangement of the various elements is not limited. Except as noted otherwise below, the pumps can just as easily push fluids into the heat exchanger 10 as draw fluids from the heat exchanger 10.

In operation, and referring now to FIGS. 1-6, water is pumped from the water source 12 by the water pump 13 to enter the feedpipe 72 at the top of the heat exchanger 10. It is contemplated that the water first fills the space between the outer collar 22 and the inner collar 74 before flowing over the inner collar 74 and onto the upper tubesheet 32 of the double-tubesheet 30. The inner collar 74 thereby disperses water evenly across the upper tubesheet 32 of the double-tubesheet 30 to flow uniformly through each of the holes 34 in the upper tubesheet 32 and into the inner tubes 62 of the cooling tubes 60. Accordingly, a water flow path is directed downward through the interior of the inner tubes 62 before water exits through the bottom of the inner tubes 62 and through the openings 52 in the lower tubesheet 50 of the triple-tubesheet 40.

Although not shown, it is contemplated that the exemplary heat exchanger 10 includes a cover that extends over the outer collar 22. As such, the overflow pipe 76 removes excess water that otherwise would negatively affect flow of water into the inner tubes 62. In some embodiments, this excess water is then returned to the water source 12, as shown, for example, in FIG. 6.

Referring still to FIGS. 1-6, in one exemplary implementation, a refrigerant is pumped from the refrigerant source 14 by the refrigerant pump 15 through the ports 88 and into the upper cavity 86 of the triple-tubesheet 40 at the bottom of the heat exchanger 10. The refrigerant then flows through the holes 44 in the upper tubesheet 42 and into the annular cavity 84 defined between the inner tubes 62 and the outer tubes 64 of the cooling tubes 60. Accordingly, in this exemplary implementation, the refrigerant is directed upward through the annular cavity 84 before entering the cavity 82 of the double-tubesheet 30. The refrigerant then flows through the ports 80 before returning to the refrigerant source 14. Of course, in other embodiments and implementations, the refrigerant may be first pumped through the ports 80 into the cavity 82 of the double-tubesheet 30 before flowing downward through the annular cavity 84 and into the upper cavity 86 of the triple-tubesheet 40 before exiting the ports 88. In other words, the refrigerant feed can be of a top-feed or bottom-feed design.

Regardless of the particular direction of the refrigerant flow path, as water flows through the water flow pathway (i.e., through each of the inner tubes 62), and the refrigerant flows through the refrigerant flow pathway (i.e., through the annular cavity 84 between inner tubes 62 and the outer tubes 64), heat is transferred from the water to the refrigerant, causing ice to form on the interior surfaces of the inner tubes 62. After the appropriate amount of ice is produced, an ice removal process is executed.

In one exemplary embodiment, the ice is removed by flowing a warm fluid, such as air or water, between the cooling tubes 60 within the internal cavity 92 of the heat exchanger 10. In particular, heated fluid is pumped from the heater 16 by the pump 17 through the port 90 at the top of the heat exchanger 10 and into the internal cavity 92. The fluid then passes through the inner cavity 92 with the baffles 94 providing relatively uniform flow across all of the cooling tubes 60 before exiting the port 96 at the bottom of the heat exchanger 10. According to this exemplary embodiment, as the cooling tubes 60 gradually heat up, a thin layer of ice is melted, and the tubes of ice are released from the heat exchanger 10. It is contemplated that this particular ice removal process results in ice with a dry surface characteristic. This is desirable in applications in which the ice machine is used to generate ice for immediate bagging in packaged ice plants.

In other embodiments, however, the internal cavity 92 of the heat exchanger 10 is filled with insulating material to avoid excessive environmental heat loads on the smaller heat transfer surfaces. As such, other ice removal processes are also contemplated. For example, in another exemplary embodiment, the ice is removed by displacing the cold refrigerant with a warm refrigerant, for example a warm refrigerant gas, in the annular cavity 84 between the inner tubes 62 and the outer tubes 64. As the refrigerant is heated, a thin layer of ice is melted, and the tubes of ice are released from the heat exchanger 10. In some particular embodiments, the warm refrigerant displaces the cold refrigerant to a holding drum (not shown), where it is retained temporarily in order to reduce the time required to pull down the temperature for the next ice making cycle.

With respect to the lower cavity 56 of the triple-tubesheet 40, in this exemplary embodiment, it is contemplated that the lower cavity 56 is used to subcool the refrigerant flowing through the lower cavity 56 before entering the upper cavity 86 of the triple-tubesheet 40. In particular, warm refrigerant first flows through the lower cavity 56 of the triple-tubesheet 40 by way of the ports 54 before entering the upper cavity 86 of the triple-tubesheet 40 by way of the ports 88. When cold water flows through the inner tubes 62, the warm refrigerant flowing through the lower cavity 56 of the triple-tubesheet 40 will cool while remaining at the same pressure. This gives additional refrigeration capacity for the heat exchanger 10. Furthermore, the relatively warm refrigerant in the lower cavity 56 of the triple-tubesheet 40 prevents ice formation on the bottom face of the lower tubesheet 50 which permits quicker release of the ice.

In some embodiments, it is contemplated that a double-tubesheet is utilized at the bottom of the heat exchanger. In such embodiments, the lower tubesheet 50 of the triple-tubesheet 40 described above is not present. Therefore a structure substantially similar to the middle tubesheet 46 described above functions as a "lower tubesheet" of the double-tubesheet at the bottom of the heat exchanger.

With respect to the cooling tubes 60 themselves, in the exemplary heat exchanger 10 described above, the inner tube 62 and the outer tube 64 are each made of stainless steel having a thickness of about 0.049 inches. In some preferred embodiments, the inner tube 62 has a diameter of about 0.50" to about 2.00", while the outer tube 64 has a diameter of about 1.00" to about 2.50". In one preferred embodiment, the inner tube 62 has a diameter of 1.25", and the outer tube 64 has a diameter of 1.50". Thus, in some preferred embodiments, the width of the annular cavity 84 (i.e., the distance between the outer surface of the inner tube 62 and the inner surface of the outer tube 64) is therefore between about 0.0625" to about 0.25". In one preferred embodiment, the width of the annular cavity 84 is about 0.125".

Of course, the above dimensions are only exemplary and can be readily modified by one skilled in the art based on the intended use of the ice machine. For example, the diameter of the inner tube 62 is chosen for a desired diameter of ice. The diameter of the outer tube 64, and therefore the width of the annular cavity 84, can then be determined based on the type of refrigerant used. If a high-pressure refrigerant, such as carbon dioxide (R744), is used, a smaller outer tube 64 is required as compared to if a low-pressure refrigerant, such as ammonia (R717), is used. Furthermore, it is contemplated that, when increasing the diameter of the inner tube 62 or the overall length of the cooling tubes 60, the width of the annual cavity 84 may, in some instances, also need to be increased to maintain an adequate rate of ice production. Alternatively, the rate of flow of the refrigerant through a similarly sized annual cavity 84 may be increased to accommodate an increase in the diameter or length of the inner tube 62. The thickness of the inner tube 62 and the outer tube 64 is likewise determined based on expected pressure and flow rates.

Regardless of the particular configuration of the present invention, advantageously, the relatively small annular cavity 84 between the inner tube 62 and outer tube 64 of each cooling tube 60 permits the use of significantly lower refrigerant charge over the prior art. Furthermore, with sufficient tube wall and tubesheet thicknesses, the design is inherently practical for use with high pressure refrigerants like carbon dioxide (R744), even in a hot gas defrost configuration.

By limiting the refrigerant to flow only within the annular cavity 84, the design of the present invention reduces the evaporator charge by approximately 85% for a 1¼" tube Vogt® P34AL and requires no higher flow rate of refrigerant to achieve the same rate of ice production. The ice-making tubes remain fully wetted with refrigerant, but the smaller space lends itself to meeting the needs of a low-charge system. Additionally, the annulus is inherently stronger, easily meeting the higher working pressure needs of R744 and other high-pressure working fluids.

One of ordinary skill in the art will recognize that additional embodiments are possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the present invention.

What is claimed is:

1. An ice machine, comprising:

a shell defining an internal cavity; and a plurality of cooling tubes extending through the internal cavity of the shell, each cooling tube including an inner tube and an outer tube extending around the inner tube, thus defining an annular cavity between the inner tube and the outer tube;

wherein, when a refrigerant flows through the annular cavity between the inner tube and the outer tube, water in the inner tube freezes;

wherein no refrigerant can pass between the annular cavity defined by each of the plurality of cooling tubes and the internal cavity of the shell.

2. The ice machine of claim 1, wherein, water flows through the inner tube in a first direction, and the refrigerant flows through the annular cavity in a second direction opposite of the first direction.

3. The ice machine of claim 1, and further comprising:

a heater and a pump operably connected to the internal cavity of the shell to provide a heated fluid which flows through the internal cavity and across the plurality of cooling tubes.

4. The ice machine of claim 1, wherein each of the cooling tubes is spaced apart from each of the other cooling tubes.

5. The ice machine of claim 1, and further comprising:

an upper tubesheet defining a plurality of holes, with an upper end of one of the inner tubes mated to the upper tubesheet at each of the holes, and a lower tubesheet spaced apart from the upper tubesheet, the lower tubesheet defining a plurality of holes, with an upper end of one of the outer tubes mated to the lower tubesheet at each of the holes, such that a cavity defined between the upper tubesheet and the lower tubesheet is in fluid communication with the annular cavity between the inner tube and the outer tube but no fluids can pass between (i) the cavity defined between the upper tubesheet and the lower tubesheet and (ii) the internal cavity of the shell by way of the plurality of holes defined by the lower tubesheet.

6. The ice machine of claim 1, and further comprising:

a lower tubesheet defining a plurality of holes, with a lower end of one of the inner tubes mated to the lower tubesheet at each of the holes, and an upper tubesheet spaced apart from the lower tubesheet, the upper tubesheet defining a plurality of holes, with a lower end of one of the outer tubes mated to the upper tubesheet at each of the holes, such that a cavity defined between the upper tubesheet and the lower tubesheet is in fluid communication with the annular cavity between the inner tube and the outer tube but no fluids can pass between (i) the cavity defined between the upper tubesheet and the lower tubesheet and (ii) the internal cavity of the shell by way of the plurality of holes defined by the upper tubesheet.

7. The ice machine of claim 6, and further comprising:

a third tubesheet spaced apart from the lower tubesheet and opposite the upper tubesheet, the third tubesheet defining a plurality of holes such that a cavity is defined between the lower tubesheet and the third tubesheet, with a lower end of one of the inner tubes mated to the third tubesheet at each of the holes, wherein no fluids can pass between (i) the cavity defined between the lower tubesheet and the third tubesheet and (ii) the cavity defined between the upper tubesheet and the lower tubesheet by way of the plurality of holes defined by the lower tubesheet.

8. The ice machine of claim 1, and further comprising:

a double-tubesheet at one end of the ice machine, including an upper tubesheet defining a plurality of holes, with an upper end of one of the inner tubes mated to the upper tubesheet at each of the holes, and a lower tubesheet spaced apart from the upper tubesheet, the lower tubesheet defining a plurality of holes, with an upper end of one of the outer tubes mated to the lower tubesheet at each of the holes, such that a cavity defined between the upper tubesheet and the lower tubesheet is in fluid communication with the annular cavity between the inner tube and the outer tube; and a triple-tubesheet at an opposite end of the ice machine, including an upper tubesheet defining a plurality of holes, with a lower end of one of the outer tubes mated to the upper tubesheet at each of the holes, a middle tubesheet spaced apart from the upper tubesheet, the middle tubesheet defining a plurality of holes, with one of the inner tubes extending through and mated to each of the holes, such that a cavity defined between the upper tubesheet and the middle tubesheet is in fluid communication with the annular cavity between the inner tube and the outer tube, and a lower tubesheet spaced apart from the middle tubesheet and opposite the upper tubesheet, the lower tubesheet defining a plurality of holes such that a cavity is defined between the lower tubesheet and the middle tubesheet, with a lower end of one of the inner tubes mated to the lower tubesheet at each of the holes, wherein, in the triple-tubesheet, no fluids can pass between (i) the cavity defined between the lower tubesheet and the middle tubesheet and (ii) the cavity defined between the upper tubesheet and the middle tubesheet by way of the plurality of holes defined by the middle tubesheet.

9. The ice machine of claim 1, and further comprising:

a first upper tubesheet defining a plurality of holes, with an upper end of one of the inner tubes mated to the first upper tubesheet at each of the holes;

a first lower tubesheet spaced apart from the first upper tubesheet, the first lower tubesheet defining a plurality of holes, with one of the inner tubes passing through each of the holes and with an upper end of one of the outer tubes mated to the first lower tubesheet at each of the holes, such that a cavity defined between the first upper tubesheet and the first lower tubesheet is in fluid communication with the annular cavity between the inner tube and the outer tube, but no fluids can pass between (i) the cavity defined between the first upper tubesheet and the first lower tubesheet and (ii) the internal cavity of the shell by way of the plurality of holes defined by the first lower tubesheet;

a second lower tubesheet defining a plurality of holes, with a lower end of one of the inner tubes mated to the second lower tubesheet at each of the holes; and a second upper tubesheet spaced apart from the second lower tubesheet, the second upper tubesheet defining a plurality of holes, with one of the inner tubes passing through each of the holes and with a lower end of one of the outer tubes mated to the second upper tubesheet at each of the holes, such that a cavity defined between the second upper tubesheet and the second lower tubesheet is in fluid communication with the annular cavity between the inner tube and the outer tube, but no fluids can pass between (i) the cavity defined between the second upper tubesheet and the second lower tubesheet and (ii) the internal cavity of the shell by way of the holes defined by the second upper tubesheet.

10. An ice machine, comprising:

a heat exchanger, including a shell defining an internal cavity, and a plurality of cooling tubes positioned in and extending through the internal cavity, each cooling tube including an inner tube and an outer tube extending around the inner tube, thus defining an annular cavity between the inner tube and the outer tube;

a water source operably connected to a water pump to provide water which flows through the inner tube in a first direction; and a refrigerant source operably connected to a refrigerant pump to provide a refrigerant which flows through the annular cavity in a second direction opposite the first direction;

wherein no refrigerant can pass between the annular cavity defined by each of the plurality of cooling tubes and the internal cavity of the shell.

11. The ice machine of claim 10, wherein the heat exchanger is vertically oriented such that, the plurality of cooling tubes extend vertically through the internal cavity of the shell, the water flows downward through the inner tube, and the refrigerant flows upward through the annular cavity.

12. The ice machine of claim 10, and further comprising:

a heater and a pump operably connected to the internal cavity of the shell to provide a heated fluid which flows through the internal cavity and across the plurality of cooling tubes.

13. The ice machine of claim 12, wherein each of the cooling tubes is spaced apart from each of the other cooling tubes.

14. The ice machine of claim 10, wherein, at one end of the ice machine, the heat exchanger further comprises:

an upper tubesheet defining a plurality of holes, with an upper end of one of the inner tubes mated to the upper tubesheet at each of the holes; and a lower tubesheet spaced apart from the upper tubesheet, the lower tubesheet defining a plurality of holes, with an upper end of one of the outer tubes mated to the lower tubesheet at each of the holes, such that a cavity defined between the upper tubesheet and the lower tubesheet is in fluid communication with the annular cavity between the inner tube and the outer tube;

wherein the refrigerant pump causes the refrigerant to flow through the annular cavity by way of the cavity defined between the upper tubesheet and the lower tubesheet.

15. The ice machine of claim 10, wherein, at one end of the ice machine, the heat exchanger further comprises:

an upper tubesheet defining a plurality of holes, with a lower end of one of the outer tubes mated to the upper tubesheet at each of the holes;

a middle tubesheet spaced apart from the upper tubesheet, the middle tubesheet defining a plurality of holes, with one of the inner tubes extending through and mated to each of the holes, such that a cavity defined between the upper tubesheet and the middle tubesheet is in fluid communication with the annular cavity between the inner tube and the outer tube; and a lower tubesheet spaced apart from the middle tubesheet and opposite the upper tubesheet, the lower tubesheet defining a plurality of holes such that a cavity is defined between the lower tubesheet and the middle tubesheet, with a lower end of one of the inner tubes mated to the lower tubesheet at each of the holes, wherein no fluids can pass between (i) the cavity defined between the lower tubesheet and the middle tubesheet and (ii) the cavity defined between the upper tubesheet and the middle tubesheet by way of the plurality of holes defined by the middle tubesheet;

wherein the refrigerant pump causes the refrigerant to flow through the annular cavity by way of the cavity defined between the upper tubesheet and the middle tubesheet.

16. The ice machine of claim 15, wherein the refrigerant pump causes the refrigerant to initially flow through the cavity defined between the lower tubesheet and the middle tubesheet before flowing through the cavity defined between the upper tubesheet and the middle tubesheet and then through the annular cavity.

17. The ice machine of claim 16, wherein the refrigerant flowing through the cavity defined between the lower tubesheet and the middle tubesheet is subcooled.

18. An ice machine, comprising:

a heat exchanger, including a shell defining an internal cavity, a plurality of cooling tubes positioned in and extending through the internal cavity, each cooling tube including an inner tube and an outer tube extending around the inner tube, thus defining an annular cavity between the inner tube and the outer tube;

an upper tubesheet defining a plurality of holes, with a lower end of one of the outer tubes mated to the upper tubesheet at each of the holes, a middle tubesheet spaced apart from the upper tubesheet, the middle tubesheet defining a plurality of holes, with one of the inner tubes extending through and mated to each of the holes, such that a cavity defined between the upper tubesheet and the middle tubesheet is in fluid communication with the annular cavity between the inner tube and the outer tube, and a lower tubesheet spaced apart from the middle tubesheet and opposite the upper tubesheet, the lower tubesheet defining a plurality of holes, with a lower end of one of the inner tubes mated to the lower tubesheet at each of the holes, such that a cavity is defined between the lower tubesheet and the middle tubesheet, a water source operably connected to a water pump to provide water which flows through the inner tube in a first direction; and a refrigerant source operably connected to a refrigerant pump to provide a refrigerant which flows through the annular cavity in a second direction opposite the first direction;

wherein the refrigerant pump causes the refrigerant to initially flow through the cavity defined between the lower tubesheet and the middle tubesheet before flowing through the cavity defined between the upper tubesheet and the middle tubesheet and then through the annular cavity.

* * * * *